United States Patent [19]

Borne et al.

[11] Patent Number: 4,481,492

[45] Date of Patent: Nov. 6, 1984

[54] ROTARY ELECTRIC SWITCH WITH AN AUTOMATIC MECHANISM WHICH RESETS IT WHEN NO VOLTAGE IS APPLIED THERETO

[75] Inventors: André Borne, Villeurbanne; André Marmonier, Bron; Etienne Briguet, Rillieux-la-Pape, all of France

[73] Assignee: Cgee Alsthom, Levallois-Perret, France

[21] Appl. No.: 444,117

[22] Filed: Nov. 24, 1982

[30] Foreign Application Priority Data

Nov. 26, 1981 [FR] France ..... 81 22132

[51] Int. Cl.[3] ..... H01H 9/20

[52] U.S. Cl. ..... 335/164; 335/20; 335/190; 335/166

[58] Field of Search ..... 335/164, 165, 166, 189, 335/190, 20, 155, 73, 174

[56] References Cited

U.S. PATENT DOCUMENTS 4,001,740 1/1977 MacLean ..... 335/190

FOREIGN PATENT DOCUMENTS 731081 2/1943 Fed. Rep. of Germany .

2268346 11/1975 France .

2481514 10/1981 France .

*Primary Examiner*—Harold Broome

*Attorney, Agent, or Firm*—Sughrue, Mion, Zinn, Macpeak, and Seas

[57] ABSTRACT

The switch includes an electromagnet (9) with a moving core (10) which is retracted when voltage is applied. A configuration of three levers (11, 12, 13) which are fixed together in pairs when the switch is cocked. The first lever (11) is integral with the rotary control shaft (3). The second lever (12) pivots on a stationary middle shaft (23) due to the respective actions of the core being released and of an antagonistic spring (15). The third lever (13) pivots on the end shaft (28), is provided with a return spring (16) and holds the control shaft (3) and the first lever (11) in position by being fixed to the other two levers. The third lever which has a middle lock projection (29) for the first lever also has a transversal passage (24) with a notch (27) in which the free end (25) of the second lever (12) can move, said free end itself having a hooked portion (26) which co-operates with the notch (27) in the tripped position and allowing manual or automatic return to the rest position.

5 Claims, 11 Drawing Figures

ROTARY ELECTRIC SWITCH WITH AN AUTOMATIC MECHANISM WHICH RESETS IT WHEN NO VOLTAGE IS APPLIED THERETO

The present invention relates to a rotary electric switch with an automatic mechanism to reset the switch to a rest position when no voltage is applied thereto.

FIELD OF THE INVENTION

Such a rotary electric switch conventionally includes a plurality of contacts disposed in groups, e.g. in pairs, in a stack of contact cells. Each contact in a group includes a moving component and a stationary component; the movement of the moving component is controlled by a control shaft which is common to the various contact cells and generally runs along the centers thereof. The control shaft has cams disposed in each cell stage so as to selectively control the movements of the moving components of the contacts as a function of the rotation of the shaft whether under manual control or under servo-control.

Very often, automatic devices are added to such switches to return them automatically to a rest position in the case of an appreciable drop in voltage, e.g; to avoid untimely switching on of electric units controlled by the switch once the electric current supplied to said switch has been cut off.

Such a return device is described in particular in the Applicant's French patent specification FR- A No. 22481 514; it describes a control shaft which is provided with a spring to return it to the rest position, which spring is connectric with said shaft and fitted with a cam which co-operates with two levers arranged to be sensitive to the position of the core of an electromagnet supplied with the voltage that is to be monitored. When the electromagnet is normally supplied it is possible to position the control shaft in a cocked position which electrically switches as required and holds the switching positions. When the electromagnet is not fed at a sufficient voltage, the position of the core and its action on the levers triggers the return of the control shaft to the rest position by means of its return spring.

Such a device has the disadvantage of making it essential to provide an energizing contact for the electromagnet which must be closed as soon as manual control begins so as to allow the levers to operate so that the switch is held in the cocked position. Requiring said energizing contact to be actuated before the others complicates the switch and can make it necessary to add an extra contact cell which is otherwise useless, e.g. in the case where four contacts are required to control the controlled electric unit, and where each contact cell is designed for two or four contacts.

Preferred embodiments of the present invention therefore provide a rotary electric switch with an automatic mechanism which resets the switch automatically when no voltage is applied thereto, thereby making it possible to mitigate the above-mentioned disadvantages, in so far as the switch is capable of being fed with the monitored voltage at all times during the cocking operation.

SUMMARY OF THE INVENTION

The present invention provides a rotary electric switch with an automatic mechanism for resetting the switch to rest position when insufficient voltage is applied thereto, said switch including, for said purpose, a control shaft fitted with a return spring for returning it to the rest position, an electromagnet with a moving core which, when released on a drop in voltage, triggers the return, and a configuration of three levers fixed together in pairs when switch is cocked, a first lever being integral with the control shaft, a second lever pivoting on a stationary middle shaft under the control of the respective actions of the core when released and of an antagonistic spring, a third lever pivoting on a stationary end shaft and fitted with a return spring, to firstly hold the control shaft and the first lever in the operating position by fixing it to the other levers and secondly to release the first lever and cause the return of the switch to the rest position when said third lever is released by the second lever which is itself actuated by the core being released, wherein in said switch the shafts of the first and second levers are disposed at the same end of the third lever whose middle has a lock projection for the first lever and whose free end has a notched transversal passage in which the furthest end from the core of the second lever can move, said end having a hooked portion located on the other side and opposite end to said second lever relative to the core so as to fix the end of the second lever in the notch of the notched passage when the core is retracted due to the effect of an electric voltage being applied to the electromagnet and the control shaft is placed in the cocked position.

Preferably the shafts of the first and second levers are disposed on the same side of the third lever whose middle has a lock projection for the first lever and, at its free end, a notched transversal passage in which the furthest end of the second lever from the core is movable, said end having a hooked portion located at the furthest end from and on the other side of said lever relative to the core, so as to fix the end of the second lever in the notch of the passage when the core is retracted due to the action of the voltage applied to the electromagnet and when the control shaft is placed in the cocked position.

The notch of the transversal passage may bear against the bearing surface of the hooked portion at an obtuse angle which promotes detaching while the return spring of the control shaft produces a force on the second lever which prevents detaching when the core is not released, the three levers remaining fixed together due to the opposing actions of the control shaft return spring and of the return springs of the second and third levers.

The force of the control shaft return spring such as applied to the second lever in the cocked position of the switch may be greater than that of the return spring of the second layer so that the first lever releases itself from the lock projection of the third lever due to effect of the return spring of the control shaft in the case where the hooked portion is released due to the action of the released core.

BRIEF DESCRIPTION OF THE DRAWINGS

Embodiments of the invention are described by way of example with reference to the accompanying drawings in which.

MORE DETAILED DESCRIPTION

Figure 1:
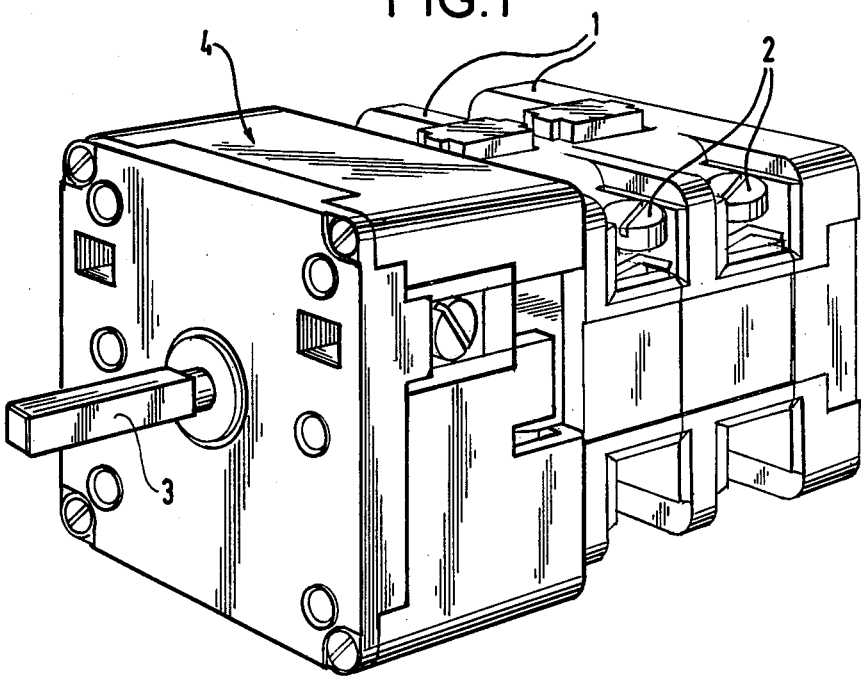
FIG. 1 is a perspective view of an embodiment of a rotary electric switch with an automatic mechanism which resets the switch and to which the invention applies.

The embodiment of a rotary switch shown in FIG. 1 conventionally has a set of contact cells 1 which have connection terminals 2 connected to stationary contact units which co-operate with moving contact units. The moving contacts move under the control of a control shaft 3 to make or break electric connections as a function of the position of the control shaft 3.

Said control shaft 3 passes through the centers of the contact cell 1 and also passes through a housing 4 which contains a mechanism for automatically returning said shaft and the contacts which it controls to the rest position in the event of a voltage drop.

Figure 2:
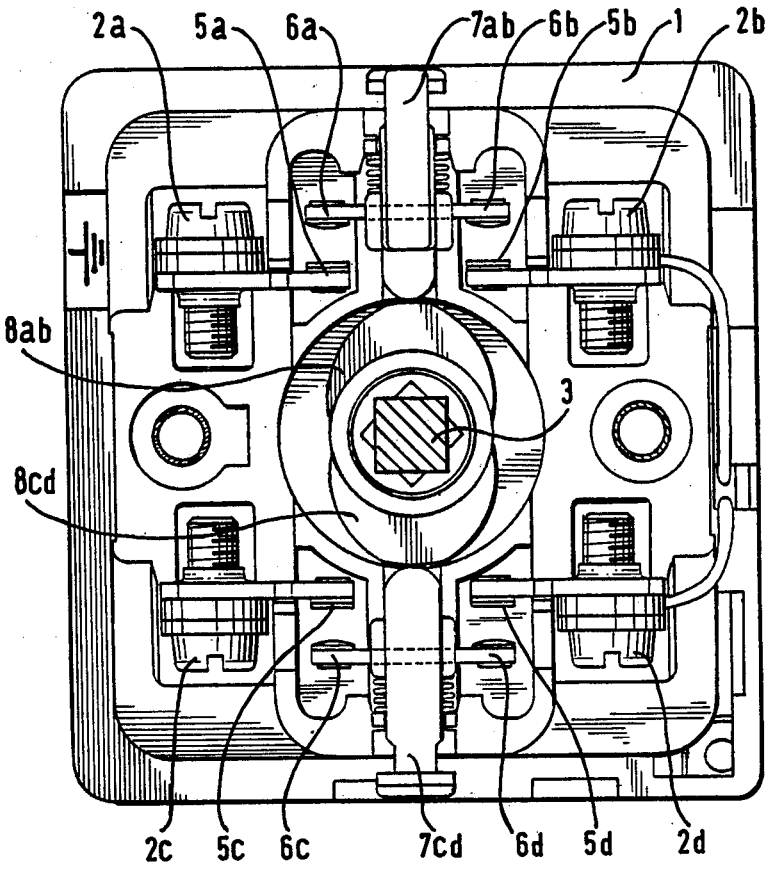
FIG. 2 is an elevation of the housing of an embodiment of a contact cell of a rotary switch to which the invention applies.

FIG. 2 is a front view of a contact cell 1 showing the positions of the connection terminals 2, the control shaft 3, the stationary units 5 and the moving units 6. In the example chosen, four connection terminals 2*a*, 2*b*, 2*c*, 2*d* are connected to as many stationary contact units 5*a*, 5*b*, 5*c*, 5*d* which are capable of being connected in pairs by means of moving components 6*a*, 6*b*, 6*c*, 6*d* controlled in pairs by control pistons 7*ab* and 7*cd*.

Each piston 7 has one pair of moving contacts per unit such as 6*a* and 6*b* for the piston 7*ab* which move with the piston due to the action of a cam 8 rotated by the control shaft 3.

Said control shaft 3 is provided with a handle or with a servo-control unit (not illustrated), so that it can be operated from outside the switch. It also passes through the housing which contains the mechanism for automatic return to the rest position.

Figure 3A:
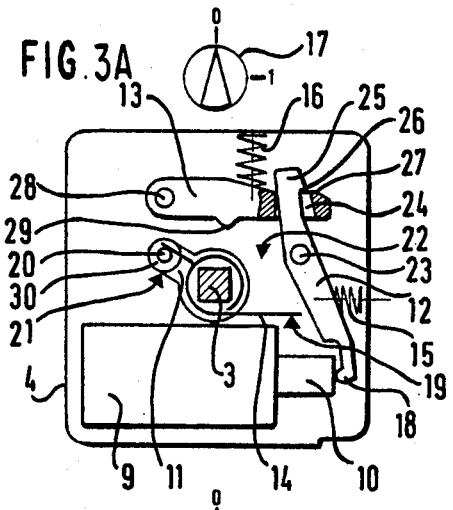
FIGS. 3A to 3F are operating diagrams of the return mechanism in accordance with the invention at various stages during operation.
Figure 3B:
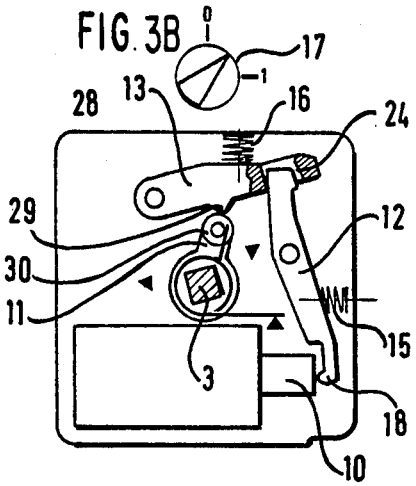
Figure 3C:
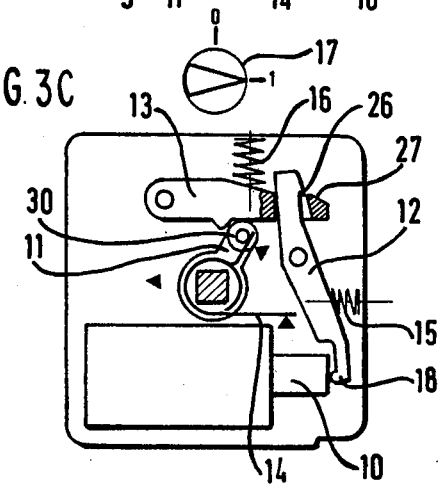
Figure 3D:
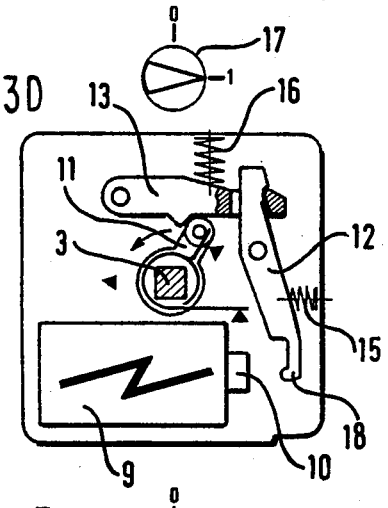
Figure 3E:
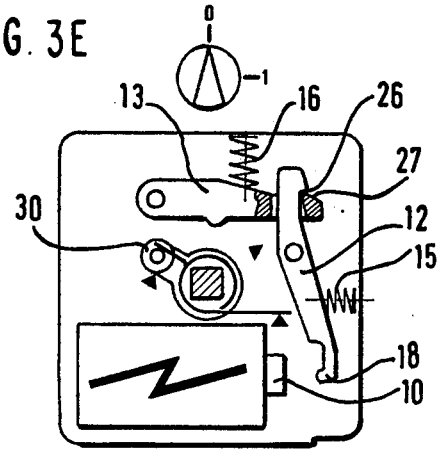
Figure 3F:
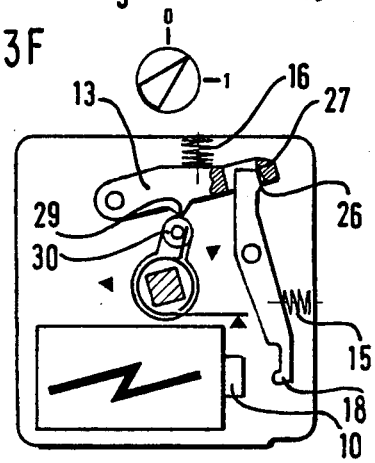
Figure 4:
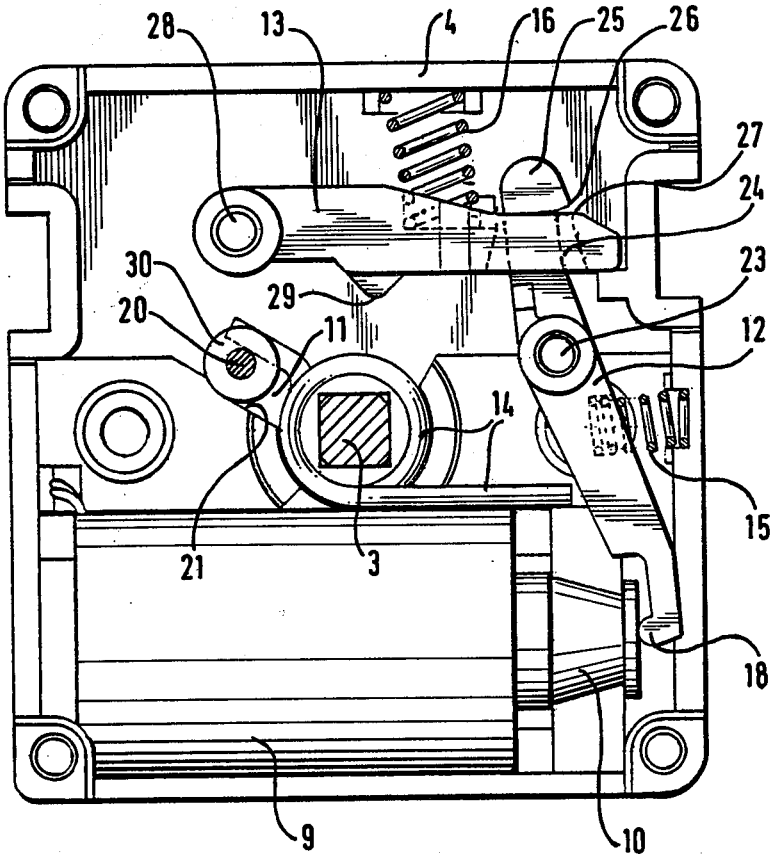
FIG. 4 is a front view of a return mechanism in accordance with the invention.
Figure 5:
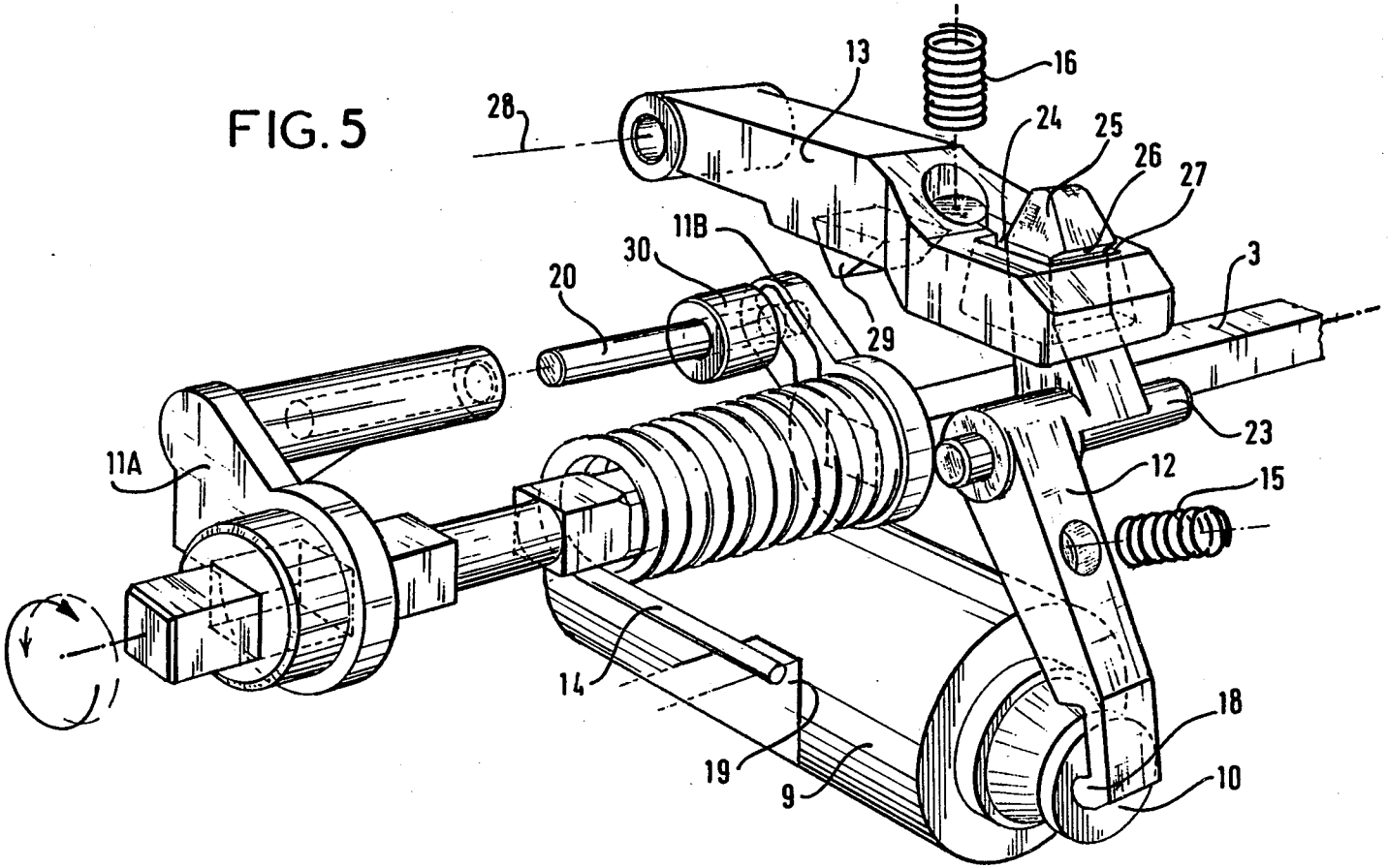
FIG. 5 is an exploded perspective view of a return mechanism in accordance with the invention.

Said housing and its mechanism are outlined in different operating stages in FIGS. 3A to 3F and are shown in greater detail in FIGS. 4 and 5.

The mechanism uses an electromagnet 9 with a moving core 10, and a release mechanism consisting of three levers 11, 12, 13 each fitted with a return spring 14, 15, 16 respectively. The figures also show a control handle 17 drawn above the housing in FIGS. 3A to 3F, said handle being fixed to the front end of the control shaft 3 in the case of a manually controlled switch.

When sufficient voltage is applied to the electromagnet 9, the moving core 10 retracts inside the electromagnet as shown in FIGS. 3D to 3F. A voltage drop below said level is sufficient to cause the core 10 to be released due to the action of a return spring, not shown, and the end of the core pushes back the end 18 of the lever 12 placed roughly perpendicular to the axis of movement of the core 10.

In contrast, when the core 10 is retracted, the end 18 of the lever 12 no longer presses against the core 10 due to its interaction with the lever 13, despite the action of the return spring 15 which bears against the neighbouring wall of the housing 4 to push it back towards said core 10.

The control shaft 3 is provided with a lever 11 herein referred to as the first lever which is fitted to the control shaft so as to rotate with it; said shaft has a concentric return spring 14 which tends to return it from the active (usually "on") position such as illustrated in FIG. 3D towards the rest (usually "off") position illustrated in FIGS. 3A and 3E.

Said spring 14 conventionally bears against a stationary point of the housing symbolically indicated by an arrow 19 and on a lug 20 integral with the lever 11, two stops being indicated symbolically by arrows 21 and 22 limiting the travel of the lever 11 and consequently the rotation of the control shaft 3, e.g. to one fourth of a turn.

The lever 12, herein referred to as the second lever, pivots about a stationary shaft 23 which is disposed on the same side of the lever 13 as the control shaft 3, said stationary shaft 23 is offset from the middle of the lever 12 so as to provide two arms of unequal length; it pivots between two fixed positions under the action of the core 10 in the released position and of the opposing spring 15 respectively. These two fixed positions are limited by the dimensions of a notched transversal passage 24 provided at the free end of the third lever 13 located approximately parallel to the axis of movement of the moving core 10. With this aim in view, the end of the second lever 12 enters the transversal passage 24 in which it is free to move somewhat in the plane of FIG. 3, i.e. perpendicularly to the shaft 3.

A hooked portion 26 is provided on the other end and other side of the second lever 12 relative to the core 10; said hooked portion 26 is capable of co-operating with a notch 27 in the transversal passage 24 so as to keep the levers 12 and 13 fixed together under conditions which are defined further on.

The lever 13 is capable of pivoting about a stationary shaft 28 placed at its end furthest from that through which the transversal passage 24 passes; said stationary shaft 28 is disposed beyond the shaft 3 so as to allow the lever 11 to be locked in the cocked position (1) of the control shaft 3 by means of a lock projection 29 provided in the middle of said lever 13 on the side adjacent said control shaft 3.

In the example chosen, a roller 30 on the lug 20 of the lever 11 bears against the lock projection 29 when the control shaft 3 is in the cocked position. The return spring 16 returns the lever 13 to its rest position where it bears against a wall of the housing 4.

In the rest position (0) of the control shaft 3 and when no voltage is applied, the first lever 11 presses against the stop 21, the core 10 is in the released position and pushes back the end 18 of the second lever 12, the end 25 of said lever 12 presses its furthest wall from the hooked portion 26 against the portion of the transversal passage 24 which is the nearest to the shaft 28 (FIG. 3A). If the control shaft is rotated clockwise, the roller 30 of the first lever 11 lifts the lock projection 29 (FIG. 3B) and consequently the lever 13 which turns about its shaft 28, compressing the spring 16 while the second lever 12 remains motionless.

When the rotation of the control shaft 3 is complete (FIG. 3C) the lever 13 is pushed back towards the control shaft 3 by the spring 16 and presses against the roller 30, the second lever 12 remains motionless in the position defined by the core 10 when released.

On releasing the control handle, the return spring 14 of the control shaft 3 pushes back the third lever 13 despite the action of the spring 16.

Indeed, arrangements are made for the resultant of the forces applied by the spring 14 and by the spring 16 on the lever 13 to cause said lever to rise and the first lever 11 to disengage if the two levers 12 and 13 are not hooked together.

In contrast, assuming that the electromagnet 9 is fed with current via one of the contacts of the switch, e.g. on the, or one of the, supply current phases, as soon as the contacts are established, after complete rotation of the control shaft 3, the core 10 is retracted (FIG. 3D), the lever 12 is pushed back by the spring 15 and the hooked portion 26 engages in the notch 27 of the transversal passage 25.

In the example envisaged, the notch 27 of the transversal passage presses against the bearing surface of the hooked portion 26 at an obtuse angle which promotes unhooking.

The opposing actions of the spring 14 (which is the return spring of the control shaft) and of the lever springs 15 and 16 keep the three levers fixed together in pairs. Turning the control shaft by hand or by servomechanism allows it to be returned to the rest position (0) by making the action of the first lever 11 preponderant and by disturbing the otherwise established balance. The notch 27 slides on the wall of the hooked portion 26 and the lever 13 turns, compressing the spring 16, the roller 30 becomes released and returns to the rest position (FIG. 3F). The rotation of the control shaft 3 opens the contacts and cuts the electricity supply to the electromagnet 9 whose core 10 is released. In the case of cut-off or of appreciable drop in potential with which the electromagnet 9 is supplied (and which is taken downstream from the contacts of the switch in the present case) while the switch is normally cocked, the core 10 is released and it pushes back the end 18 of the lever 12; this separates the hooked portion 26 from the notch 27. The withdrawal of the hooked portion 26 towards the shaft 28 of the lever 13 releases said lever which is raised by the action of the lever 11, the shaft 3 returning to the rest position thereby cutting the electricity supply to the electromagnet 29 whose core 10 is released; the switch is then in the position of FIG. 3A.

Alternatively, the electromagnet 9 can also be supplied with voltage which is not switched by contacts of the switch.

In such a case, if the electromagnet 9 is supplied with tension while the control shaft 3 is in the rest position (0), the core 10 is retracted (FIG. 3E) and the two levers 12 and 13 are hooked together, possibly below the hooked portion 26. While the control shaft 3 is rotating from the rest position (0) to the cocked position, the force applied via the roller 30 of the lever 11 makes it possible for the notch 27 to slide on the bearing surface of the hooked portion 26, this allowing the lever 13 to be raised.

When the projection 29 has passed over the roller 30, the lever 13 comes closer to the control shaft 3 under the action of the spring 16 (FIG. 3F); at the end of the travel, the notch 27 and the hooked portion 26 engage together again and the assembly is again in the position illustrated in FIG. 3D.

The exploded view of FIG. 5 schematically shows the positioning of the internal mechanism of the housing and in particular the three levers 11, 12, 13, the electromagnet 9 and its core 10 as well as the springs 14, 15, 16.

The return spring 14 which is concentric with the control shaft 3 of the switch bears against a stop 19 of the housing and against the lug 20 of the lever 11. Here, the lever 11 is composed of two distinct parts 11A and 11B; part 11A fits onto the lug 20 to allow it to withstand mechanical stresses imposed on it by the return spring 14.

The roller 30 mounted on the lug 20 is lodged under the lock projection 29 between said notch and the end of the lever 13 in which is provided the transversal passage 24 containing the end 25 of the lever 12.

The shaft 28 of the lever 13 is not illustrated; it is partially integral with the housing as are the bearings of the shaft 23 and the bearings of the shaft 3 level with the parts 11A and 11B of the lever 11.

Likewise, the springs 15 and 16 bear against the walls of the housing which is not illustrated in this figure for clearness' sake.

Figure 6:
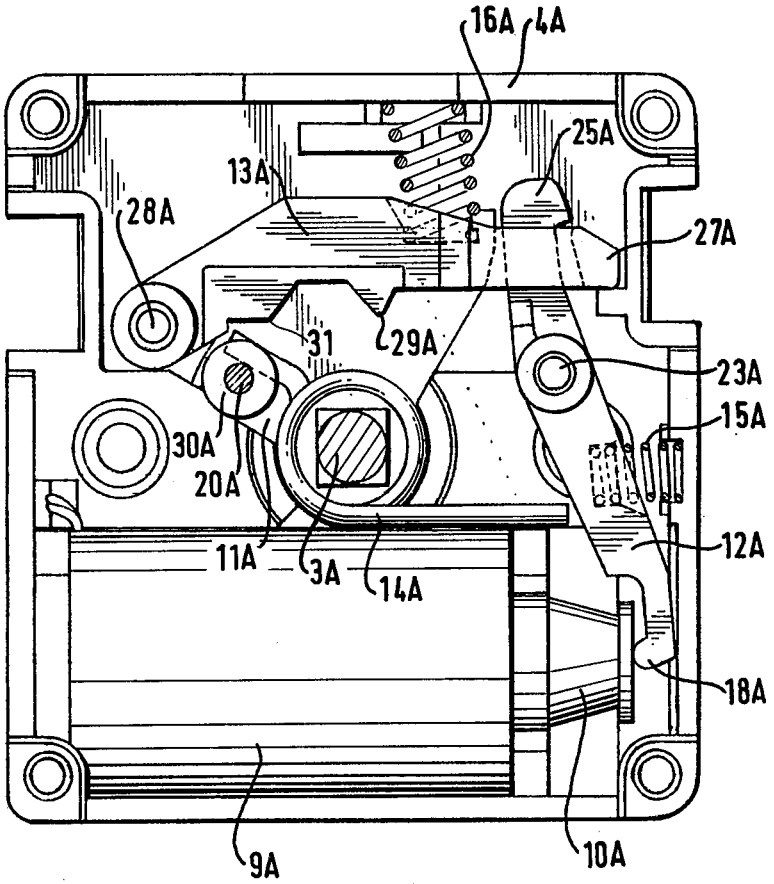
FIG. 6 shows an embodiment with an extra switching position compared to the embodiment illustrated in FIG. 4.

The variant shown in FIG. 6 corresponds to a rotary electric switch with a mechanism for automatic re-setting to a rest position when no tension is applied and which has three switching positions, i.e. including an extra position relative to the aforementioned embodiment. This is intended to provide two active positions besides the rest position to which the switch is returned when no voltage is applied, whatever the active position at the instant when the supply voltage to the electromagnet (here referenced 9A) drops.

In the present variant, the return mechanism components illustrated in FIG. 6 are practically identical to those illustrated in FIG. 4 except for the third lever (here referenced 13A), an index A being added in FIG. 6 to the references of components which are common to both figures. The lever 13A has a lock notch 31 disposed between the mid lock projection 29A and the end shaft 28A on which the lever 13A pivots.

Of course, the extra lock notch 31 is placed at the same end of the third lever 13A as the mid lock projection 29A so as to co-operate with the roller 30A of the first lever 11A in the same way as said mid lock notch.

Consequently, starting from the rest position with no voltage applied, rotation of the operation shaft 3A causes the lever 13A to rise due to the action of the roller 20A on the lock notch 31 then the return of said notch to its former position due to the action of the spring 16A with the second lever 12A fixed to the third lever 13A if the movable core 10A of the electromagnet 9A is in the retracted position due to the fact that sufficient electric voltage is being supplied to the electromagnet. If the rotation of the control shaft 3A is not continued the switch is set and held in a first stable control position as long as the electromagnet 9A is suitably powered and as long as the control shaft 3A does not operate. If the control shaft 3A continues to rotate in the control direction, the roller 20A again raises the third lever 13A by actuating the mid lock projection 29A. When the roller 20A passes beyond said projection 29A the switch is set in a second stable control position as in the case previously described by a projection such as 29.

In the case of a voltage drop below a predetermined minimum level, whatever the control position the switch is set in, the release of the core 10A causes the release of the third lever 13A, which becomes detached from the second lever 12A and the return of the first lever 11A to the rest position due to the action of the spring 14A as already previously described.

In a known way, each active position selects a different configuration of the switch contacts.

We claim:

1. A rotary electric switch with an automatic mechanism for resetting the switch to a rest position when insufficient voltage is applied thereto, said switch including, for said purpose, a rotatable control shaft fitted with a return spring for rotatably returning it to the rest position, an electromagnet with a moving core which, when released on a drop in voltage, triggers the return, and a configuration of three levers fixed together in pairs when said switch is cocked, said three levers comprising; a first lever integral with the control shaft, a second lever pivoting on a stationary middle shaft under the control of the respective actions of the core when released and of an antagonistic spring, a third lever pivoting on a stationary end shaft and fitted with a return spring to firstly hold the control shaft and the first lever in the operating position by fixing it to the other levers and secondly to release the first lever and cause the return of the switch to the rest position when said third lever is released by the second lever which is itself actuated by the core being released, the improvement wherein, in said switch, the shafts of the first and second levers are disposed on the same side of the third lever, said third lever having at its middle a lock projection for the first lever and a free end having a notched transversal passage in which the furthest end of the second lever from the core can move, said furthest end having a hooked portion located on the other side and opposite end to said second lever relative to the core so as to fix the end of the second lever in the notch of the notched passage when the core is retracted due to the effect of an electric voltage being applied to the electromagnet and the control shaft is placed in the cocked position.

2. An electric switch according to claim 1, wherein the notch of the transversal passage bears against the bearing surface of the hooked portion at an obtuse angle which promotes detaching and wherein the return spring of the control shaft combines with the return spring of the second lever to produce a return force which prevents detaching when the core is not released from the core.

3. An electric switch according to claim 2, wherein the force of the control shaft return spring is greater than that of the spring of the third lever so that the first lever releases itself from the lock projection of the third lever due to the effect of the return spring of the control shaft in the case where the hooked portion is released due to the action of releasing the core.

4. An electric switch according to claim 2, wherein the controlled rotation of the control shaft against the pull of the return spring when the core is retracted causes the notch in the transversal passage to slide on the bearing surface of the hooked portion and the third lever to rise and allow the first lever to pass beyond the lock projection of the third lever, then the hooked part of the second lever to be attached again to the notch in the transversal passage and the cocking of the switch under safety conditions identical to those of a switch including an extra contact for applying voltage to an electromagnet.

5. An electric switch according to claim 1, wherein the third lever has a lock notch located between the lock projection in the middle of the third lever and the end on which the third lever pivots.

* * * * *